US011492082B2

(12) United States Patent
Robinson

(10) Patent No.: US 11,492,082 B2
(45) Date of Patent: Nov. 8, 2022

(54) BUMPER HOLDER

(71) Applicant: Latch-n-Catch, Inc., Van, TX (US)

(72) Inventor: Gregory Robinson, Van, TX (US)

( * ) Notice: Subject to any disclaimer, the term of this patent is extended or adjusted under 35 U.S.C. 154(b) by 24 days.

(21) Appl. No.: 17/130,388

(22) Filed: Dec. 22, 2020

(65) Prior Publication Data

US 2021/0188407 A1 Jun. 24, 2021

Related U.S. Application Data

(60) Provisional application No. 62/953,231, filed on Dec. 24, 2019.

(51) Int. Cl.
*B63B 59/02* (2006.01)

(52) U.S. Cl.
CPC ..... *B63B 59/02* (2013.01)

(58) Field of Classification Search
CPC ..... B63B 59/00; B63B 59/02
USPC ..... 114/219
See application file for complete search history.

(56) References Cited

U.S. PATENT DOCUMENTS 5,676,085 A * 10/1997 Michl, Jr. ..... B63B 21/00 114/230.1
9,038,556 B2 * 5/2015 Ulgen ..... B63B 59/02 114/219

* cited by examiner

*Primary Examiner* — Lars A Olson
(74) *Attorney, Agent, or Firm* — Kirby Drake

(57) ABSTRACT

A bumper holder may attach or clamp to a variety of types of personal watercraft (PWC) to provide a bumper. The bumper holder may be used to hold the PWC in place regardless whether the PWC is docked or in use. The bumper holder does not require being near a dock/pier or piling to be used. The bumper holder may have a clamp that may connect to a PWC. The clamp may be affixed to a first bar that may be attached to a second bar using a hinge portion. The second bar may include the bumper at the end opposite the hinge portion. The bumper holder may include a lock bar that may connect and secure a top portion of the first bar to the second bar. The first bar and the second bar may be telescopic and/or adjustable.

18 Claims, 3 Drawing Sheets

BUMPER HOLDER

CROSS-REFERENCE TO RELATED APPLICATION

The present application is a non-provisional of, and claims priority to, U.S. Patent Application No. 62/953,231, filed Dec. 24, 2019, which is incorporated by reference in its entirety.

FIELD OF THE DISCLOSURE

The present disclosure generally relates to bumpers, and more particularly to bumper holders to connect to personal watercraft (PWC) without the PWC being docked or attached to a piling.

BACKGROUND

When PWC, including but not limited to, bass boats, pontoon boats, and/or kayaks, are being used for fishing or other water activities, the PWC is often secured to the dock/pier or a piling to provide stabilization. However, this can limit the user's flexibility to select where he/she fishes or conducts water activities, as it may be dictated by the location of the dock/pier and/or the piling.

SUMMARY

Embodiments of the present disclosure may provide a bumper holder that may attach or clamp to a variety of types of PWC to provide a bumper. The bumper holder may be used to hold the PWC in place and provide stability regardless whether the PWC is docked or in use. The bumper holder does not require being near a dock/pier or piling to be used. The bumper holder may have a clamp that may connect to a PWC. The clamp may be affixed to a first bar that may be attached to a second bar using a hinge portion. The second bar may include the bumper at the end opposite the hinge portion. The bumper holder may include a lock bar that may connect and secure a top portion of the first bar to the second bar. The first bar and the second bar may be telescopic and/or adjustable.

Embodiments of the present disclosure also may provide a bumper holder assembly to mount to a personal watercraft (PWC), the bumper holder assembly comprising: a pedestal formed by parallel elongated members connected by a pin, the pedestal attaching to the PWC; a first bar attached to the pedestal; a second bar, the second bar attached to the first bar through a hinge portion; and a bumper attached to the second bar at an end opposite the hinge portion, wherein when mounted to the PWC, the pedestal holds the bumper in a specified location. The pin may include a round head at each end of the pin, and each of the round heads may be telescopic. The first bar and the second bar may be formed of a material that securely hold the pedestal and the bumper in place relative to one another. The first bar and the second bar may be formed of metal. The bumper holder assembly may extend to approximately 8 feet from the hinge portion. The bumper may be integrated with the pedestal, the first bar, and the second bar or may be detachable from the second bar. The hinge portion may permit folding of the first bar onto or around the second bar. The bumper holder assembly also may include a lock bar that connects and secures a top portion of the first bar to the second bar. The first bar and/or the second bar may be telescopic.

Further embodiments of the present disclosure may provide a bumper holder assembly to mount to a personal watercraft (PWC), the bumper holder assembly comprising: a mount that attaches to the PWC; a first bar attached to the mount; a second bar, the second bar attached to the first bar through a hinge portion; and a bumper attached to the second bar at an end opposite the hinge portion, wherein when mounted to the PWC, the mount holds the bumper in a specified location. The mount may be a pedestal formed by parallel elongated members connected by a pin or may be a clamp. The bumper holder assembly may include a lock bar that connects and secures a top portion of the first bar to the second bar. The first bar and the second bar may be formed of a material that securely hold the mount and the bumper in place relative to one another. The hinge portion may permit folding of the first bar onto or around the second bar. The bumper holder assembly may extend to approximately 8 feet from the hinge portion. The bumper may be detachable from the second bar. The first bar and/or the second bar may be telescopic.

BRIEF DESCRIPTION OF THE DRAWINGS

For a more complete understanding of this disclosure, reference is now made to the following description, taken in conjunction with the accompanying drawings, in which.

DETAILED DESCRIPTION

Embodiments of the present disclosure may provide a bumper holder that may attach or clamp to a variety of types of personal watercraft (PWC) including, but not limited to, bass boats, pontoon boats, and/or kayaks, to provide a bumper. While a bumper may be described or used herein, it should be appreciated that a buoy, a float, or other floatation-type mechanism also may be used or referenced without departing from the present disclosure. The bumper holder may be used to hold the PWC in place regardless whether the PWC is docked or in use, such as for fishing or other water activities. The bumper holder according to embodiments of the present disclosure does not require being near a dock/pier or piling to be used.

Figure 1A:
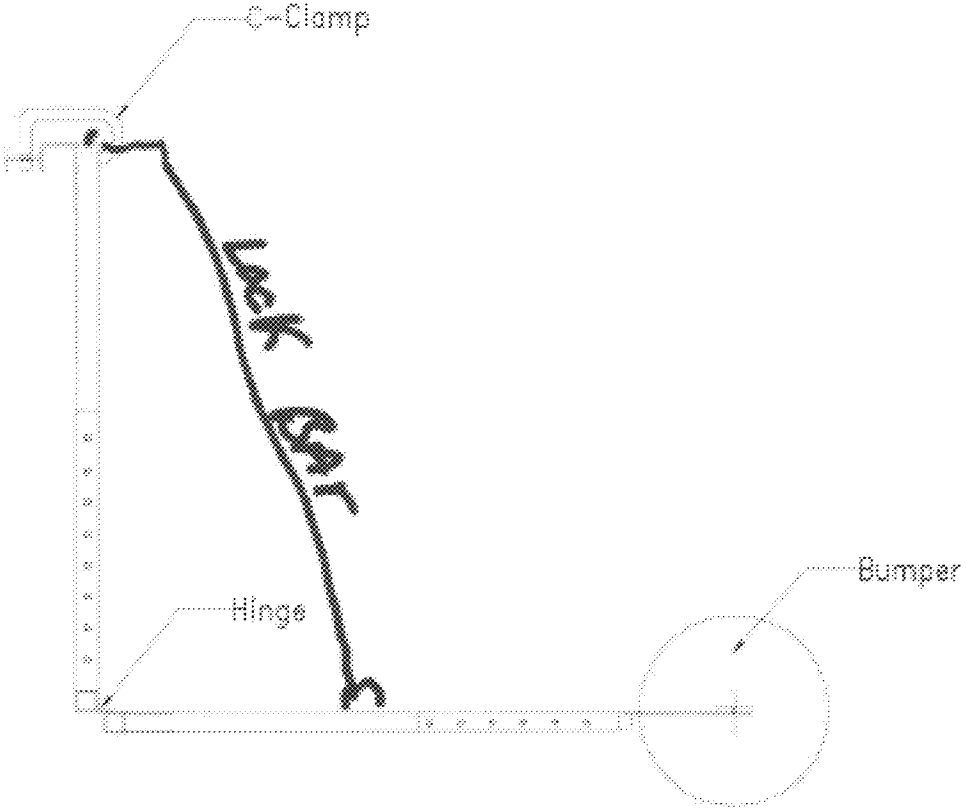
FIG. 1A depicts one view of a bumper holder according to an embodiment of the present disclosure.

FIG. 1A depicts one view of a bumper holder according to an embodiment of the present disclosure. The bumper holder may have a clamp, such as a C clamp, that may connect to a PWC. While a C clamp is depicted in FIG. 1A, it should be appreciated that other types of clamps or securing mechanisms may be used without departing from the present disclosure.

The clamp may be affixed to a first bar that may be attached to a second bar at a right angle using a hinge portion. While bars are referred to herein, it should be appreciated that poles or other similar items may be used without departing from the present disclosure. Further, while the bars may be formed of metal, it should be appreciated that the bars may be formed of plastic or other materials that may be capable of securely holding the clamp and the bumper in place relative to one another in embodiments of the present disclosure.

The second bar may include the bumper at an end opposite the hinge portion. The hinge portion may permit the first bar to fold onto or around the second bar, such as for transport, in embodiments of the present disclosure. While a hinge portion is referred to herein, another axis or juncture mechanism may be utilized without departing from the present disclosure. In some embodiments of the present disclosure, the bumper holder may include a lock bar that may connect and secure a top portion of the first bar around the clamp to the second bar. The lock bar may be integrally formed as part of the bumper holder or it may be removably secured to the bumper holder in embodiments of the present disclosure. It also should be appreciated that the first bar and the second bar may be telescopic and/or adjustable in embodiments of the present disclosure as described in more detail herein.

Figure 1B:
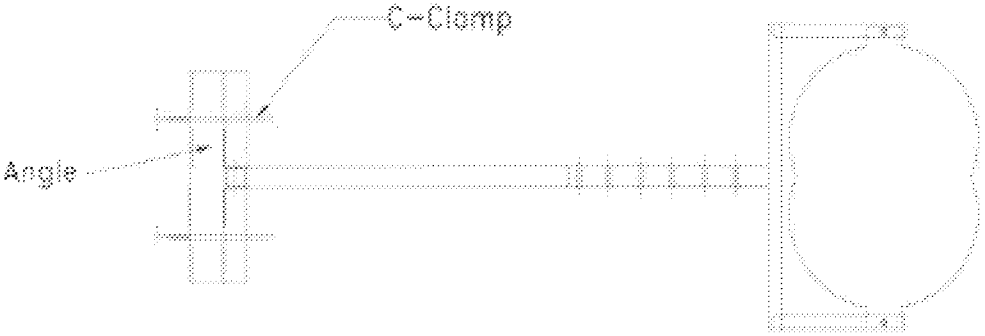
FIG. 1B depicts another view of a bumper holder according to an embodiment of the present disclosure.

FIG. 1B depicts another view of a bumper holder according to an embodiment of the present disclosure. As with the bumper holder in FIG. 1A, the bumper holder of FIG. 1B may have a clamp, such as a C clamp, that may connect to the PWC. The clamp is connected to a first bar (not specifically depicted in FIG. 1B) that may be attached to a second bar at an angle. The second bar may include the bumper at the end opposite the angled portion connecting the first bar and the second bar. It should be appreciated that the angled portion may be the hinged portion as referenced in FIG. 1A in embodiments of the present disclosure. The angled portion may permit the first bar to fold onto or around the second bar, such as for transport, in embodiments of the present disclosure. It also should be appreciated that the first bar and the second bar may be telescopic and/or adjustable in embodiments of the present disclosure.

As previously discussed with respect to FIGS. 1A-1B, the bumper holder may have a clamp, such as a C clamp, that may connect to a PWC (not shown). The clamp may be affixed to a first bar that may be attached to a second bar at a right angle using a hinge portion. The second bar may include the bumper at an end opposite the hinge portion. The hinge portion may permit the first bar to fold onto or around the second bar, such as for transport, in embodiments of the present disclosure. It also should be appreciated that the first bar and the second bar may be telescopic and/or adjustable in embodiments of the present disclosure. For example, the first bar may include a key portion that may provide for adjustability, and the panel connecting the hinge portion to the second bar may include a plurality of slots to provide for adjustability in embodiments of the present disclosure. However, other mechanisms for adjustability may be provided without departing from the present disclosure.

While a specific bumper may be depicted herein, it should be appreciated that other bumpers or buoys may be substituted without departing from the present disclosure. The bumper may be securely attached to the second bar; however, other mechanisms for securing the bumper or buoy to the second bar may be used without departing from the present disclosure.

There may be holes on the side of the first bar that may reflect the telescopic capabilities of this portion of the bumper holder. It should be appreciated that the second bar also may have telescopic capabilities according to embodiments of the present disclosure. There also may be an attachment between the hinge portion and the second bar according to an embodiment of the present disclosure. As previously discussed, the bumper holder may include a plurality of slots so that the position of the second bar may be adjusted relative to the hinge portion according to embodiments of the present disclosure.

Figure 2A:
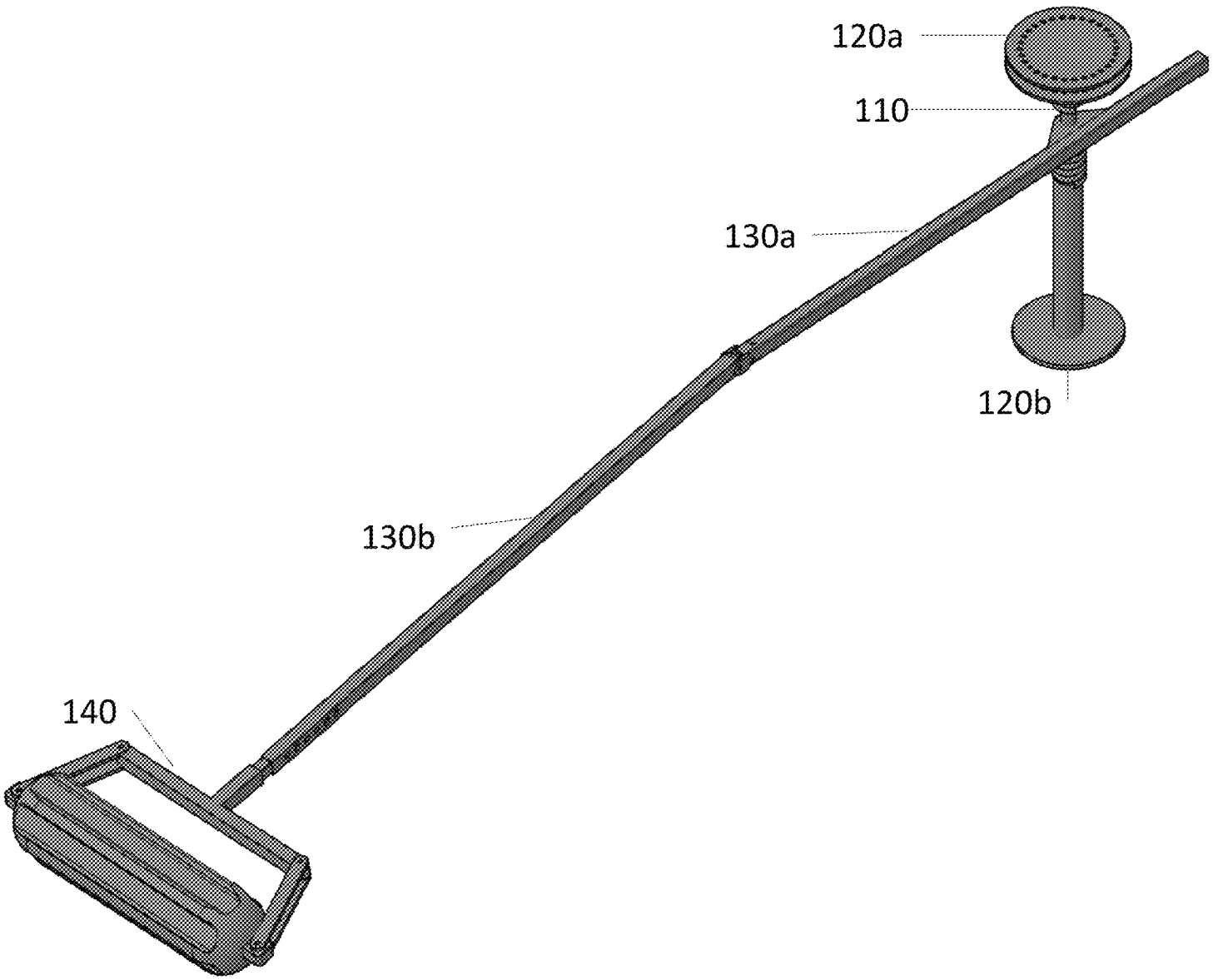
FIG. 2A depicts a bumper holder in an expanded configuration according to an embodiment of the present disclosure.

FIG. 2A depicts a bumper holder according to an embodiment of the present disclosure. Pedestal 110 may be formed by parallel elongated members that may be connected by a pin. The pin may include round heads 120A, 120B at each end of the pin. While heads 120A, 120B are described as round, it should be appreciated that heads 120A, 120B may be formed in other shapes and sizes without departing from the present disclosure. In some embodiments of the present disclosure, heads 120A, 120B may be telescopic and/or used horizontally or vertically. The pin may have a height and may provide a gap that may secure the elongated members. While a certain height and gap may be identified in FIG. 2A, it should be appreciated that this height and gap may be variable as long as the pin has a height and gap that allow it to secure the elongated members in embodiments of the present disclosure. Pedestal 110 may provide a PWC mount having an arm lock to hold the bumper in a desired location.

Pedestal 110 may be affixed to first bar 130*a* that may be attached to second bar 130*b* using a hinge portion or a pivot point that may station bumper 140 on the water surface. While bars are referred to herein, it should be appreciated that poles or other similar items may be used without departing from the present disclosure. Further, while bars 130*a*, 130*b* may be formed of metal, it should be appreciated that bars 130*a*, 130*b* may be formed of plastic or other materials that may be capable of securely holding pedestal 110 and bumper 140 in place relative to one another in embodiments of the present disclosure. It should be appreciated that the bumper holder may extend to approximately 8 feet from the hinge portion or pivot point in embodiments of the present disclosure.

Figure 2B:
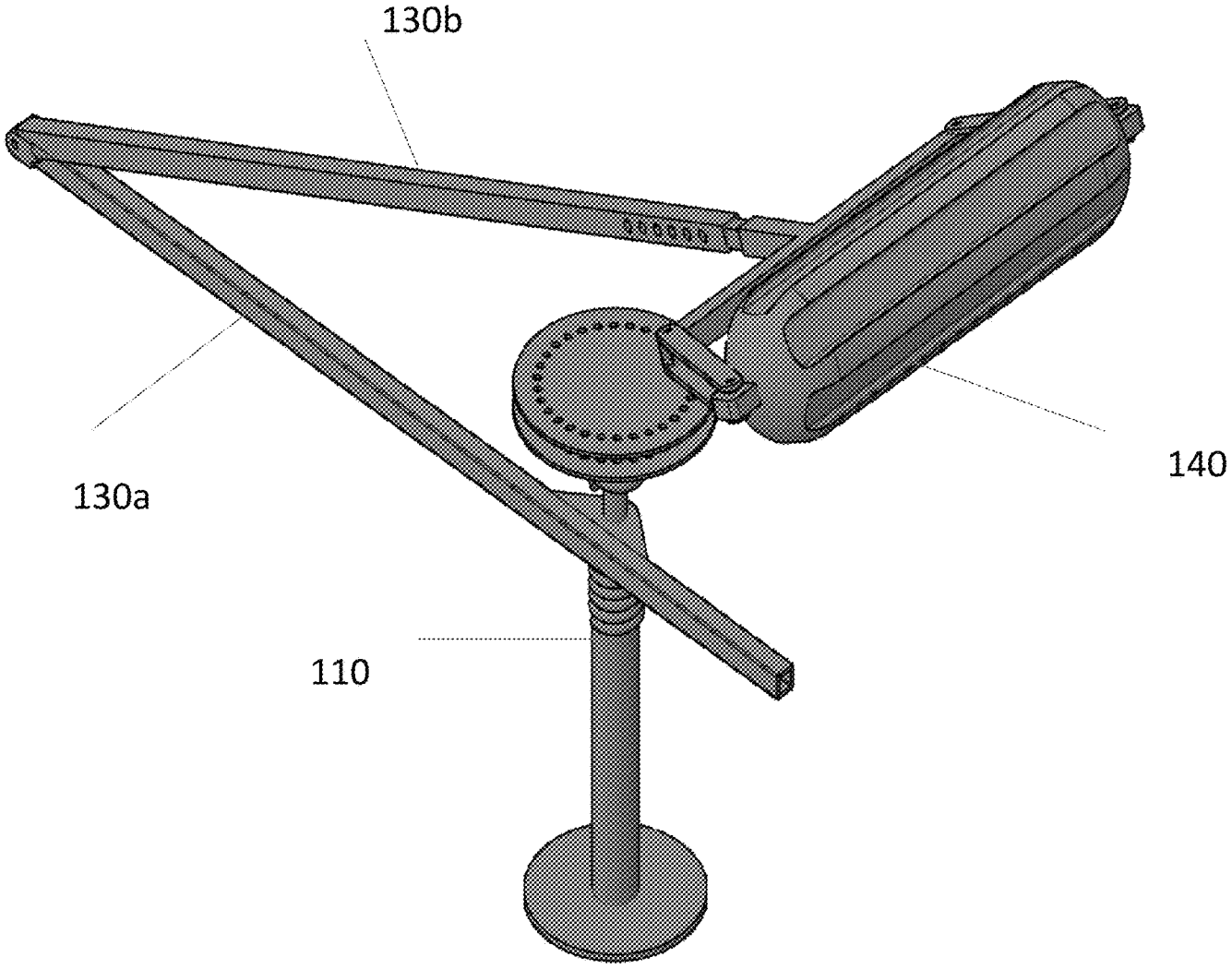
FIG. 2B depicts a bumper holder in a folded configuration according to an embodiment of the present disclosure.

Second bar 130*b* may include bumper 140 at an end opposite the hinge portion. It should be appreciated that there may be embodiments of the present disclosure where bumper 140 may be provided as part of an integrated bumper holder; however, there may be other embodiments of the present disclosure where bumper 140 may be provided separately, such as by the user. The hinge portion may permit first bar 130*a* to fold onto or around second bar 130*b*, such as for transport, in embodiments of the present disclosure. FIG. 2B depicts a bumper holder in a folded configuration according to an embodiment of the present disclosure. While a hinge portion is referred to herein, another axis or juncture mechanism may be utilized without departing from the present disclosure.

Although the present disclosure and its advantages have been described in detail, it should be understood that various changes, substitutions and alterations can be made herein without departing from the spirit and scope of the disclosure as defined by the appended claims. Moreover, the scope of the present application is not intended to be limited to the particular embodiments of the process, machine, manufacture, composition of matter, means, methods and steps described in the specification. As one of ordinary skill in the art will readily appreciate from the disclosure, processes, machines, manufacture, compositions of matter, means, methods, or steps, presently existing or later to be developed that perform substantially the same function or achieve substantially the same result as the corresponding embodiments described herein may be utilized according to the present disclosure. Accordingly, the appended claims are intended to include within their scope such processes, machines, manufacture, compositions of matter, means, methods, or steps.

The invention claimed is:

1. A bumper holder assembly to mount to a personal watercraft (PWC), the bumper holder assembly comprising:

a pedestal formed by parallel elongated members connected by a pin, the pedestal attaching to the PWC;

a first bar attached to the pedestal;

a second bar, the second bar attached to the first bar through a hinge portion; and a bumper attached to the second bar at an end opposite the hinge portion, wherein when mounted to the PWC, the pedestal holds the bumper in a specified location, and wherein the bumper holder assembly extends to approximately 8 feet from the hinge portion.

2. The bumper holder assembly of claim 1, the pin further comprising:

a round head at each end of the pin.

3. The bumper holder assembly of claim 2, wherein each of the round heads are telescopic.

4. The bumper holder assembly of claim 1, wherein the first bar and the second bar are formed of a material that securely hold the pedestal and the bumper in place relative to one another.

5. The bumper holder assembly of claim 4, wherein the first bar and the second bar are formed of metal.

6. The bumper holder assembly of claim 1, wherein the bumper is integrated with the pedestal, the first bar, and the second bar.

7. The bumper holder assembly of claim 1, wherein the bumper is detachable from the second bar.

8. The bumper holder assembly of claim 1, wherein the hinge portion permits folding of the first bar onto or around the second bar.

9. The bumper holder assembly of claim 1 further comprising:

a lock bar that connects and secures a top portion of the first bar to the second bar.

10. The bumper holder assembly of claim 1 wherein the first bar and/or the second bar are telescopic.

11. A bumper holder assembly to mount to a personal watercraft (PWC), the bumper holder assembly comprising:

a mount that attaches to the PWC;

a first bar attached to the mount;

a second bar, the second bar attached to the first bar through a hinge portion; and a bumper attached to the second bar at an end opposite the hinge portion, wherein when mounted to the PWC, the mount holds the bumper in a specified location, and wherein the bumper holder assembly extends to approximately 8 feet from the hinge portion.

12. The bumper holder assembly of claim 11, wherein the mount is a pedestal formed by parallel elongated members connected by a pin.

13. The bumper holder assembly of claim 11, wherein the mount is a clamp.

14. The bumper holder assembly of claim 11 further comprising:

a lock bar that connects and secures a top portion of the first bar to the second bar.

15. The bumper holder assembly of claim 11, wherein the first bar and the second bar are formed of a material that securely hold the mount and the bumper in place relative to one another.

16. The bumper holder assembly of claim 11, wherein the hinge portion permits folding of the first bar onto or around the second bar.

17. The bumper holder assembly of claim 11, wherein the bumper is detachable from the second bar.

18. The bumper holder assembly of claim 11 wherein the first bar and/or the second bar are telescopic.

* * * * *